US007415736B2

(12) United States Patent
Pedersen Sylvester et al.

(10) Patent No.: US 7,415,736 B2
(45) Date of Patent: Aug. 26, 2008

(54) ECOBETA

(76) Inventors: Lisbeth Pedersen Sylvester, Staunvej 29, Nibe (DK) 9240; Nils Karstensen, Knakkergaardsvej 29 Skyum, Snedsted (DK) DK 7752

( * ) Notice: Subject to any disclaimer, the term of this patent is extended or adjusted under 35 U.S.C. 154(b) by 276 days.

(21) Appl. No.: 10/886,541

(22) Filed: Jul. 9, 2004

(65) Prior Publication Data

US 2005/0005347 A1 Jan. 13, 2005

Related U.S. Application Data

(60) Provisional application No. 60/485,710, filed on Jul. 10, 2003.

(51) Int. Cl.
*E03D 1/35* (2006.01)

(52) U.S. Cl. ..... 4/393; 4/395

(58) Field of Classification Search ..... 4/378–379, 4/391, 394–395

See application file for complete search history.

(56) References Cited

U.S. PATENT DOCUMENTS

| | | | | |
|---|---|---|---|---|
| 3,831,204 | A * | 8/1974 | Cook | 4/394 |
| 4,183,107 | A * | 1/1980 | Hare et al. | 4/324 |
| 4,651,359 | A | 3/1987 | Battle | |
| 5,073,995 | A | 12/1991 | Jennison et al. | |
| 5,142,710 | A | 9/1992 | Olson | |

* cited by examiner

*Primary Examiner*—Charles E Phillips

(57) ABSTRACT

A flush regulator for retrofit use in a toilet tank for regulating the outflow therefrom through an outlet, said regulator including a flap valve without buoyancy, said flap valve adapted to close said outlet, a rod connected at one end to said flap valve and a body of buoyancy at another end of said rod above said flap valve, said flap valve adapted to close said outlet when the water level in said tank reaches the upper edge of said body of buoyancy and said buoyancy and flap valve fall to close said outlet.

16 Claims, 3 Drawing Sheets

ECOBETA

Applicant claims priority from U.S. application Ser. No. 60/485,710 filed Jul. 10, 2003.

FIELD OF THE INVENTION

This invention relates generally to water saving devices and toilet cisterns and particularly relates to a regulator for a toilet tank for regulating the outflow of liquid through an outlet. The invention further relates to an eccentric for adjusting the location of a flap valve as well as displaceable buoyancy structure for adjusting the level of flush.

BACKGROUND ART

Many existing toilet tanks and flush systems presently existing in North America have been designed and installed many years ago when the supply of fresh water was not much of a concern as it is in the present day. Generally speaking the supply of fresh water and its purification is a concern in today's society including the volume of water being flushed. This concern is even more acute for those organizations such as hotels, government bodies and other large organizations having many toilets used by many people. Such organizations are concerned with the volume of water being used for environmental reasons as well as the cost of its use.

Accordingly there have been a variety of systems and mechanisms heretobefore been designed to address this issue.

For example U.S. Pat. No. 4,651,359 relates to a dual-mode flush valve assembly.

Furthermore U.S. Pat. No. 5,073,995 relates to a water saving device for a flush tank which includes a floating body, a guide track on which the floating body is slideably mounted by a bracket, and a clip mounted to the guide track for snap fit around the stand pipe of the tank.

Furthermore U.S. Pat. No. 5,142,710 also relates to a water saver being used in a toilet tank and which includes a discharge control and flapper tank ball for controlling the flow of water from the tank or reservoir to the bowl and with the water saver having a generally cylindrical configuration with an open top and a closed bottom defining a water retaining chamber.

These and other devices and methods present relatively complicated structures.

It is an object of this invention to provide an improved regulator for a toilet tank which is simple to install and use.

DISCLOSURE OF INVENTION

It is an aspect of this invention to provide a flush regulator for retrofit use in a toilet tank for regulating the outflow therefrom through an outlet, said regulator including a flap valve without buoyancy, said flap valve adapted to close said outlet, a rod connected at one end to said flap valve and a body of buoyancy at another end of said rod above said flap valve, said flap valve adapted to close said outlet when the water level in said tank reaches the upper edge of said body of buoyancy and said buoyancy and flap valve fall to close said outlet.

It is a further aspect of this invention to provide a regulator for a toilet tank for regulating the outflow of liquid through an outlet comprising a valve for opening and closing said outlet; means for locating said valve relative said outlet; means for locating said valve relative said outlet; moveable buoyancy means disposed for slideable displacement relative said locating means for moving said valve from a closed position to an open position to permit said liquid through said outlet.

BRIEF DESCRIPTION OF DRAWINGS

Drawing 1 and 1*a* are representative drawings of the prior art.

Drawing 2 is a cross-sectional view of the invention to be described herein.

Figure 1A:
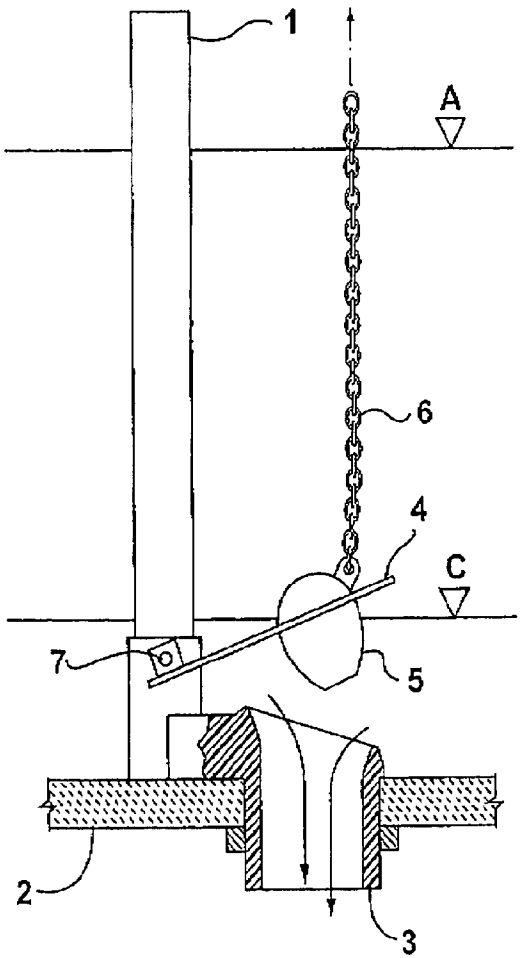
FIG. 1A (Prior Art)
Figure 1:
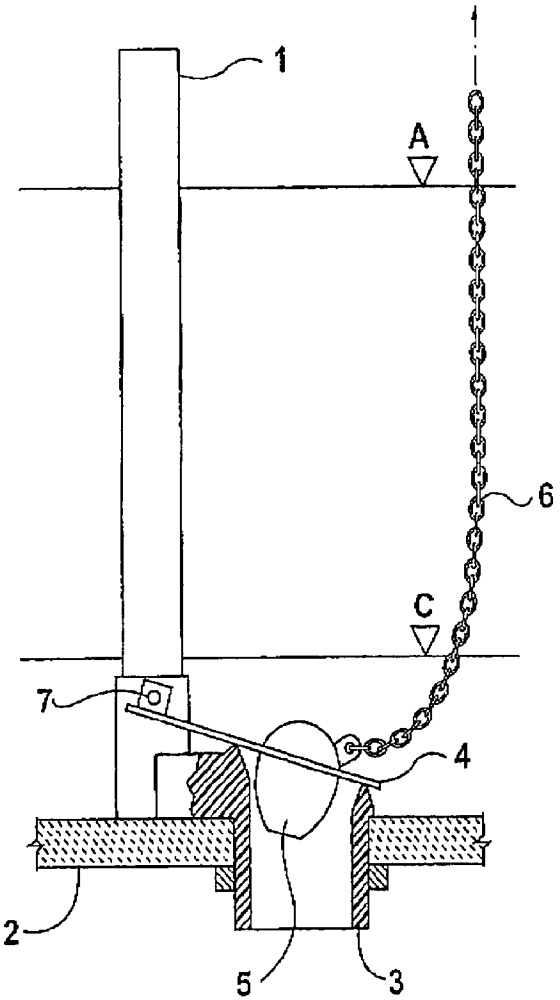
FIG. 1 (Prior Art)

Drawing 3 is a top plan view of the clip or retaining member.

Drawing 4 is a top plan view of the buoyancy means.

BEST MODE FOR CARRYING OUT THE INVENTION

In the description that follows, like parts are marked throughout the specification and the drawings with the same respective reference numerals. The drawings are not necessarily to scale and in some instances proportions may have been exaggerated in order to more clearly depict certain features of the invention.

Drawing 1.0 and 1.1 show a common flushing valve construction used in the prior art.

For example drawing 1.0 shows a common prior art overflow pipe 1 which is generally attached to the bottom 2 of the cistern having a flushing valve outlet 3 with a flushing valve flap type 4. The valve 4 pivots about pivot point 7. Accordingly when the chain 6 is pulled upwardly as shown in drawing 1.1, the body of buoyancy 5 is lifted from the closed position shown in drawing 1.0 to an open position as shown in drawing 1.1 which permits the exit of water. The body of buoyancy 5 in drawing 1.1 remains in an upward position until the water level has moved from position A to position C. Thereafter the body of buoyancy 5 of the prior art will flap downwardly to close the outlet 3 in a manner well known to those persons skilled in the art. Accordingly the volume or level of water being outputted in the prior art drawing 1.0 and 1.1 is represented by the volume or level or water moving from position A to position C.

The body of buoyancy 5 generally contains air and is holding the valve in an open position as shown in drawing 1.1 until the water in the cistern leaves the cistern through the flushing valve 3 until the water level is reaching level C. At that point the body of buoyancy 5 looses its buoyancy, returning to the closed position as shown in drawing 1.0.

Figure 2:
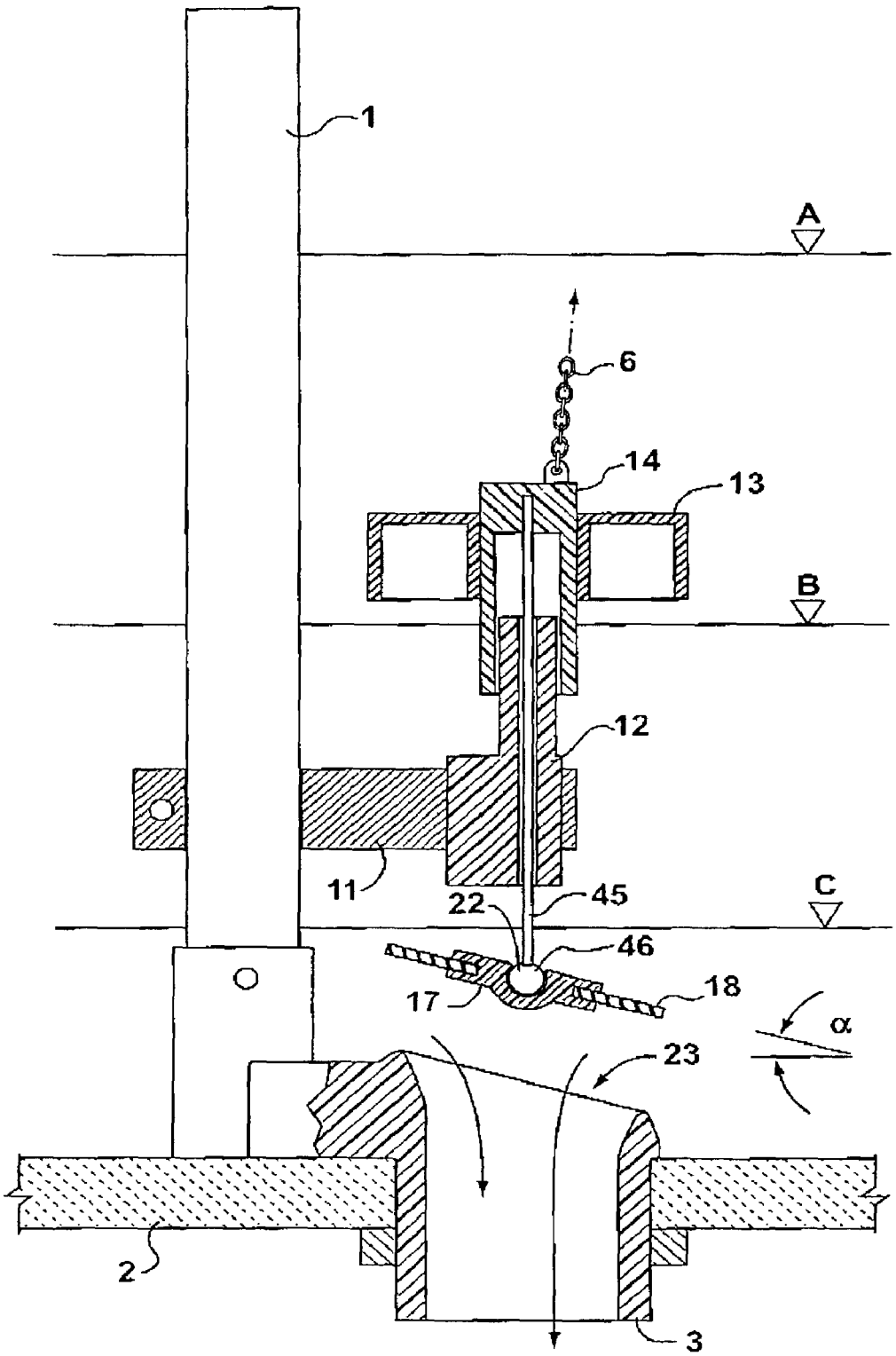
Figure 3:
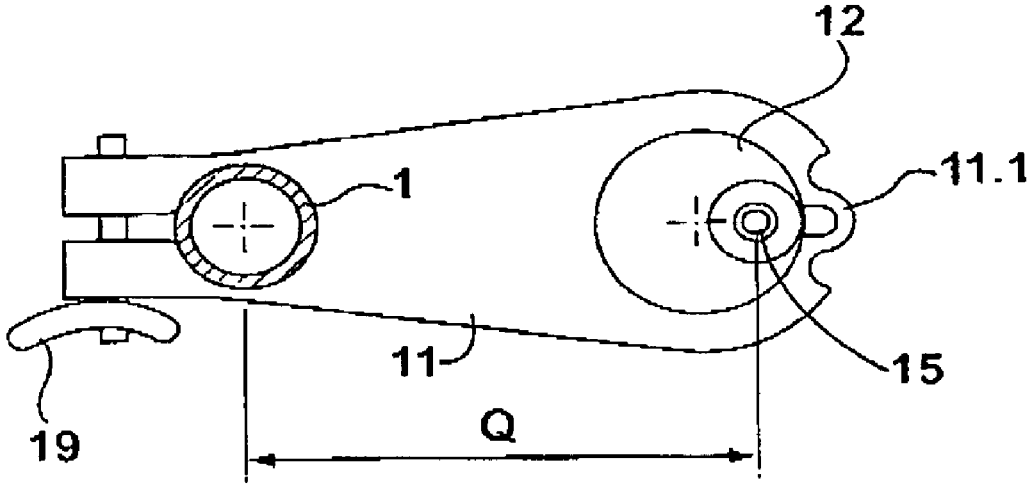
Figure 4:
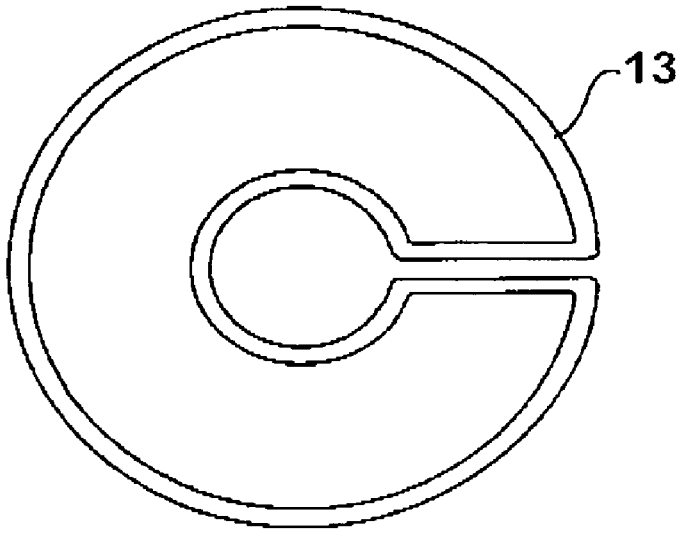

The invention to be described herein is generally shown in FIG. 2. The invention as shown in FIG. 2 can be used to replace the flap valve shown in the prior art in a simple manner. More particularly the body of buoyancy 5 and flushing valve 4 is removed by removing the pivot pin 7 and the regulator to be described herein can be retrofit as shown in FIG. 2. Alternatively the regulator can be newly installed on newly produced toilets having an overflow pipe 1.

The retrofit valve shown in FIG. 2 can be used to reduce the water consumption by closing the flushing valve not at the water level C as shown in drawing 1.0 and 1.1 but at a water level B which represents a small flush. Alternatively by holding the chain in a pulled position all the water in the cistern is leaving through the flushing valve to represent a big flush much like the prior art. Accordingly the invention to be described herein represents a dual-flush system which is achieved with the possibility of varying the water consumption as required.

More specifically drawing 2 shows the bottom of the cistern 2 having a flushing valve outlet 3 and a chain 6.

The regulator includes a retaining member 11 which can comprise a clip or other device permitting the retaining member 11 to be fastened to the overflow pipe. The retaining member includes a bore which frictionally engages a generally cylindrical body 12 having a hole therethrough. The retaining member 11 frictionally receives the generally cylindrical body 12. The generally cylindrical body 12 includes a hole therethrough which is disposed eccencric to the body. The generally cylindrical body 12 also includes an extension having a smaller diameter where the hole through the body extends through the extension. The hole is adapted to slidingly receive a rod 15 having at one end thereof a valve 17 and at the other end thereof buoyancy means. The other end 99 can include screw treads as shown. Alternativly, the buoyarcy means at the other end 99 may be secured thereto by friction, adhesive or other means. The centre line of the rod 15 relative to the centre line of the overflow pipe 1 maybe adjusted by rotating the generally cylindrical body 12 so as to move the eccentrically disposed hole or eccentric guide to a line generally concentric with the outlet 3. The cylindrical body is frictionally engaged in the bore so that once the body 12 is rotated it can be released and the hole will be located in a fixed position until it is once again moved.

Accordingly the body 12 is guiding the rod 15. In other words the distance between the centre line of the rod 15 and the centre line of the overflow pipe 1 can be adjusted as shown in drawing 3; and varies by turning the eccentric 12 relative the clamp 11. The clamp or retaining member 11 also includes an elastic area 11.1 as shown in drawing 3 to maintain friction between the eccentric 12 and the clamp 11.

The rod 15 includes at one end thereof a ball 16 which is adapted to be frictionally received by a socket 22 in the valve 17. The valve 17 also includes resilient material 18 adapted to close the outlet 3. The use of a ball 16 in the socket 22 of the valve 17 allows the valve to set on differently sloped angles $\alpha$ as shown in drawing 2 so as to conform to the orientation of the outlet seat 23 and effectively seal the outlet. In other words, the resilient material and ball and socket act to seal the seal 23. Any appropriate resilient material can be used such as rubber, plastic or other suitable material.

The buoyancy means 13 (i.e. the body of buoyancy) is fixed on an extension or intermediate socket 14 and is held in position by friction maintained by the elastomeric construction as shown in drawing 4. The body of buoyancy 13 contains air and when under water is holding the flush valve 17 and 18 in the open position. When the water level falls to level B as shown in drawing 2, the body of buoyancy looses its buoyancy and the flushing valve moves to the closed position.

The body of water level from A to B may be varied by moving the body of buoyancy 13 either up or down relative to the sliding member or socket 14. When the body of buoyancy 13 is moved upwardly relative the socket or sliding member 14 less water will be flushed while moving the body of buoyancy 13 downwardly more water will be flushed.

Accordingly the regulator shown herein may be used to replace existing flushing systems which inefficiently flush many gallons or litres of water. The regulator can be installed by removing the old prior art flushing system and clamping or fastening a retaining member 11 to the overflow pipe 1. The eccentric 12 may then be rotated to fix the centre line of the rod relative to the outlet 3. Moreover the amount of flush may be adjusted as well by moving the buoyancy member 13 relative to the socket 14 either up or down as required.

Various embodiments of the invention have now been described in detail. Since changes in and/or additions to the above-described best mode may be made without departing from the nature, spirit or scope of the invention, the invention is not to be limited to said details.

We claim:

1. A flush regulator for retrofit use in a toilet tank for regulating the outflow therefrom through an outlet, said regulator including a flap valve without buoyancy, said flap valve adapted to close said outlet, a rod connected at one end to said flap valve and a body of buoyancy at another end of said rod above said flap valve, said flap valve adapted to close said outlet when the water level in said tank reaches the upper edge of said body of buoyancy and said buoyancy and flap valve fall to close said outlet wherein said toilet tank includes an overflow pipe wherein said connecting rod between said flap valve and said body of buoyancy is guided by an eccentric guide and wherein the distance between the axis of said overflow pipe and said rod is varied by turning said eccentric guide so as to adjust the flap valve center line relative said outlet center line.

2. A flush regulator as claimed in claim 1 wherein said body of buoyancy is installed on said connecting rod by a friction assembly between said body of buoyancy and said rod.

3. A flush regulator as claimed in claim 1 wherein said body of buoyancy is installed on said connecting rod by a screw thread between said body of buoyancy and said rod.

4. A flush regulator as claimed in claim 1 wherein said body of buoyancy is frictionally clamped upon an intermediate socket to install the body of buoyancy at different levels.

5. A flush regulator for retrofit use in a toilet tank for regulating the outflow therefrom through an outlet, said regulator including a flap valve without buoyancy, said flap valve adapted to close said outlet, a rod connected at one end to said flap valve and a body of buoyancy at another end of said rod above said flap valve, said flap valve adapted to close said outlet when the water level in said tank reaches the upper edge of said body of buoyancy and said buoyancy and flap valve fall to close said outlet; wherein said connecting rod between said flap valve and said body of buoyancy is guided by an eccentric guide.

6. A flush regulator as claimed in claim 5 wherein said toilet tank includes an overflow pipe and wherein the axial distance between said overflow pipe and said rod is varied by turning said eccentric guide so as to adjust the flap valve center line relative said outlet center line.

7. A flush regulator as claimed in claim 5 wherein said eccentric guide is clamped into a clip connecting said eccentric guide with said overflow pipe, said clip provided with an elastic area so that said eccentric guide is held fast at all installed radial positions during further operation of said flush regulator.

8. A regulator for a toilet tank for regulating the outflow of liquid through an outlet comprising:

(a) a valve for opening and closing said outlet;

(b) means for locating said valve relative said outlet;

(c) moveable buoyancy means disposed for slideable displacement relative said locating means for moving said valve from a closed position to an open position to permit said liquid through said outlet;

(d) wherein said locating means is stationary relative said outlet and said buoyancy means slides relative said locating means when said valve is open for outflow of said liquid through said outlet; and (e) wherein said buoyancy means comprises:

(i) a member to slideably embrace said locating means;

(ii) a buoyancy member selectively moveable relative said slideable member to adjust the level of flush of said liquid; and (f) wherein said locating means comprises:

(i) a generally cylindrical body having a hole therethrough;

(ii) a retaining member having a bore therethrough for frictionally receiving and retaining said cylindrical body.

9. A regulator as claimed in claim 8 wherein retaining member comprises fastening means for fastening said retaining member to said overflow pipe.

10. A regulator as claimed in claim 9 wherein said hole in said generally cylindrical body is eccentrically disposed.

11. A regulator as claimed in claim 10 wherein said cylindrical body is frictionally rotatable within said bore of said retaining member for adjusting the distance between the centre line of said hole and rod to the centre line of said overflow pipe so as to position said valve over said outlet.

12. A regulator as claimed in claim 11 wherein said cylindrical body includes a cylindrical extension having a diameter smaller than said cylindrical body.

13. A regulator as claimed in claim 12 wherein said hole through said cylindrical body extends through said extension.

14. A regulator as claimed in claim 13 wherein said rod is disposed for slideable movement through said hole and said rod is connected to said valve and said slideable member.

15. A regulator as claimed in claim 14 wherein said rod is fastened to said valve by a ball and socket joint.

16. A regulator as claimed in claim 15 which is adapted to be retrofitted to any existing toilet and wherein the level of flush is adjusted by moving said buoyancy member relative said slideable member.

* * * * *